US007622230B2

(12) United States Patent
Levy et al.

(10) Patent No.: US 7,622,230 B2
(45) **Date of Patent: *Nov. 24, 2009**

(54) PHOSPHATE ESTER CONTAINING PHOTOCONDUCTORS

(75) Inventors: Daniel V. Levy, Rochester, NY (US); Jin Wu, Webster, NY (US); Liang-Bih Lin, Rochester, NY (US); Francisco J. Lopez, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 391 days.

This patent is subject to a terminal disclaimer.

(21) Appl. No.: 11/496,800

(22) Filed: Aug. 1, 2006

(65) Prior Publication Data

US 2008/0032216 A1 Feb. 7, 2008

(51) Int. Cl.
*G03G 5/14* (2006.01)

(52) U.S. Cl. ..... 430/58.8; 430/59.4; 430/60

(58) Field of Classification Search ..... 430/58.8, 430/60, 58.65, 59.4
See application file for complete search history.

(56) References Cited

U.S. PATENT DOCUMENTS

| | | | | |
|---|---|---|---|---|
| 4,265,990 | A | | 5/1981 | Stolka et al. |
| 4,464,450 | A | | 8/1984 | Teuscher |
| 4,921,769 | A | | 5/1990 | Yuh et al. |
| 5,385,796 | A | | 1/1995 | Spiewak et al. |
| 5,449,573 | A | | 9/1995 | Aoki et al. |
| 5,473,064 | A | | 12/1995 | Mayo et al. |
| 5,595,847 | A | * | 1/1997 | Nogami et al. ..... 430/64 |
| 5,928,824 | A | | 7/1999 | Obinata et al. |
| 6,015,645 | A | | 1/2000 | Murti et al. |
| 6,156,468 | A | | 12/2000 | Wehelie et al. |
| 6,177,219 | B1 | | 1/2001 | Yuh et al. |
| 6,180,309 | B1 | | 1/2001 | Maty et al. |
| 6,200,716 | B1 | | 3/2001 | Fuller et al. |
| 6,207,334 | B1 | | 3/2001 | Dinh et al. |
| 6,255,027 | B1 | | 7/2001 | Wehelie et al. |
| 6,287,737 | B1 | | 9/2001 | Ong et al. |
| 6,913,863 | B2 | | 7/2005 | Wu et al. |
| 2003/0232265 | A1 | * | 12/2003 | Yamanami et al. ..... 430/65 |
| 2004/0071884 | A1 | * | 4/2004 | Newton ..... 427/385.5 |
| 2006/0047085 | A1 | * | 3/2006 | Trivedi ..... 525/329.7 |
| 2006/0057480 | A1 | | 3/2006 | Wu et al. |
| 2007/0049677 | A1 | * | 3/2007 | Wu et al. ..... 524/430 |

OTHER PUBLICATIONS

Jin Wu et al., U.S. Appl. No. 11/211,757 on Novel Thick Undercoats, filed Aug. 26, 2005.
Liang-Bih Lin et al., U.S. Appl. No. 11/403,981 on Improved Imaging Member, filed Apr. 13, 2006.
Jin Wu et al., U.S. Appl. No. 11/410,593 on Imaging Member Having Styrene, filed Apr. 25, 2006.

* cited by examiner

*Primary Examiner*—John L Goodrow
(74) *Attorney, Agent, or Firm*—E. O. Palazzo

(57) ABSTRACT

A photoconductor containing a substrate, an undercoat layer thereover wherein the undercoat layer includes, for example, a polyol resin, an aminoplast resin, a polymeric phosphate ester adhesion component, and a metal oxide; and at least one imaging layer, such as a photogenerating and charge transport layer, formed on the undercoat layer.

40 Claims, No Drawings

PHOSPHATE ESTER CONTAINING PHOTOCONDUCTORS

CROSS REFERENCE TO RELATED APPLICATIONS

U.S. application Ser. No. 11/496,790, U.S. Publication 20080032219, filed Aug. 1, 2006, the disclosure of which is totally incorporated herein by reference, on Polyester Containing Member, by Liang-Bih Lin et al.

U.S. application Ser. No. 11/496,923, U.S. Publication 20080032221, filed Aug. 1, 2006, the disclosure of which is totally incorporated herein by reference, on Polyarylate Containing Member, by Liang-Bih Lin et al.

U.S. application Ser. No. 11/496,915, U.S. Publication 20080032218, filed Aug. 1, 2006, the disclosure of which is totally incorporated herein by reference, on Silanol Containing Photoconductor, by Jin Wu et al.

U.S. application Ser. No. 11/496,791, U.S. Publication 20080032220, filed Aug. 1, 2006, the disclosure of which is totally incorporated herein by reference, on Silicone Free Polyester Containing Member, by Daniel V. Levy et al.

U.S. application Ser. No. 11/496,912, U.S. Publication 20080032217, filed Aug. 1, 2006, the disclosure of which is totally incorporated herein by reference, on Phosphoric Acid Ester Containing Photoconductors, by Jin Wu et al.

Disclosed in U.S. Pat. No. 7,312,007, the disclosure of which is totally incorporated herein by reference, is a photoconductive member comprised of a supporting substrate, a hole blocking layer thereover, a photogenerating layer, and a charge transport layer, and wherein the hole blocking layer is comprised of a metallic component and a binder component, such as a phenolic resin.

Disclosed in copending application U.S. application Ser. No. 11/211,757, U.S. Publication 20070049677, the disclosure of which is totally incorporated herein by reference, is an electrophotographic imaging member comprising a support layer, an undercoat layer of a binder of metal oxide nanoparticles, and a co-resin comprising a phenolic resin and an aminoplast resin; a charge generation layer, and a charge transport layer.

Disclosed in copending application U.S. application Ser. No. 11/403,981, U.S. Publication 20070243476, the disclosure of which is totally incorporated herein by reference, is an electrophotographic imaging member, comprising a substrate, an undercoat layer disposed on the substrate, wherein the undercoat layer comprises a polyol resin, an aminoplast resin, and a metal oxide dispersed therein; and at least one imaging layer formed on the undercoat layer, and wherein the polyol resin is, for example, selected from the group consisting of acrylic polyols, polyglycols, polyglycerols, and mixtures thereof.

Disclosed in copending application U.S. application Ser. No. 11/410,593, U.S. Publication No. 20070248813, the disclosure of which is totally incorporated herein by reference, is an electrophotographic imaging member, comprising a substrate; an undercoat layer disposed on the substrate, wherein the undercoat layer comprises a styrene acrylic copolymer, an aminoplast resin, and a metal oxide dispersed therein; and at least one imaging layer formed on the undercoat layer.

The appropriate components and processes, number and sequence of the layers, component and component amounts in each layer, and the thicknesses of each layer of the above copending applications, especially copending applications U.S. application Ser. No. 11/211,757; U.S. application Ser. No. 11/403,981; and U.S. application Ser. No. 11/410,593, may be selected for the present disclosure in embodiments thereof.

BACKGROUND

There are disclosed herein photoconductors, and more specifically, photoconductors containing a hole blocking layer or undercoat layer (UCL) comprised, for example, of metal oxide particles, and adhesion components that permit the excellent adhesion between, for example, the hole blocking layer and the substrate, and the layers thereover, such as the photogenerating layer and the charge transport layer or layers. More specifically, there are disclosed hole blocking layers comprised of a number of the components as illustrated in the copending applications referred to herein, such as a metal oxide like a titanium dioxide, a polymeric resin or polymeric resins, such as a phenolic resin, an acrylic resin, a styrene-acrylic resin or a melamine resin, and an adhesion promoter, examples of which are a polymeric phosphate ester, an ester of phosphoric acid or optionally mixtures thereof. Charge blocking layer and blocking layer are generally used interchangeably with the phrase "undercoat layer".

Also included within the scope of the present disclosure are methods of imaging and printing with the photoresponsive or the photoconductive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the photoconductors disclosed herein can be selected for the Xerox Corporation iGEN3® machines that generate with some versions over 100 copies per minute. Processes of imaging, especially xerographic imaging and printing, including digital, and/or high speed color printing, are thus encompassed by the present disclosure.

The imaging members disclosed herein are, in embodiments, sensitive in the wavelength region of, for example, from about 400 to about 900 nanometers, and in particular from about 650 to about 850 nanometers, thus diode lasers can be selected as the light source.

REFERENCES

Illustrated in U.S. Pat. No. 6,913,863, the disclosure of which is totally incorporated herein by reference, is a photoconductive imaging member comprised of an optional supporting substrate, a hole blocking layer thereover, a photogenerating layer, and a charge transport layer, and wherein the hole blocking layer is comprised of a metal oxide, a mixture of phenolic resins, and wherein at least one of the resins contains two hydroxy groups.

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerating layer, and a charge transport layer, and wherein the blocking layer is comprised of a polyhaloalkylstyrene.

Illustrated in U.S. Pat. No. 6,287,737, the disclosure of which is totally incorporated herein by reference, is a photoconductive imaging member comprised of a supporting substrate, a hole blocking layer thereover, a photogenerating layer, and a charge transport layer, and wherein the hole blocking layer is comprised of a crosslinked polymer generated, for example, from the reaction of a silyl-functionalized hydroxyalkyl polymer of Formula (I) with an organosilane of Formula (II) and water

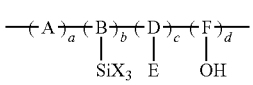

(I)

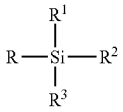

(II)

wherein, for example, A, B, D, and F represent the segments of the polymer backbone; E is an electron transporting moiety; X is selected, for example, from the group consisting of chloride, bromide, iodide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl with the substituent being halide, alkoxy, aryloxy, and amino; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Illustrated in U.S. Pat. Nos. 6,255,027; 6,177,219, and 6,156,468, each of the disclosures thereof being totally incorporated herein by reference, are, for example, photoreceptors containing a charge blocking layer of a plurality of light scattering particles dispersed in a binder, reference for example, Example I of U.S. Pat. No. 6,156,468, wherein there is illustrated a charge blocking layer of titanium dioxide dispersed in a specific linear phenolic binder of VARCUM®, available from OxyChem Company.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by the reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$ for each part of gallium chloride that is reacted; hydrolyzing the pigment precursor chlorogallium phthalocyanine Type I by standard methods, for example, by acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Illustrated in U.S. Pat. No. 4,587,189, the disclosure of which is totally incorporated herein by reference, are photoconductive imaging members comprised of a supporting substrate, a charge transport layer, a photogenerating layer of BZP perylene, which is in embodiments comprised of a mixture of bisbenzimidazo(2,1-a-1',2'-b)anthra(2,1,9-def:6,5,10-d'e'f')diisoquinoline-6,11-dione and bisbenzimidazo (2,1-a:2',1'-a)anthra(2,1,9-def:6,5,10-d'e'f')diisoquinoline-10,21-dione.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

In U.S. Pat. No. 4,921,769, the disclosure of which is totally incorporated herein by reference, there are illustrated photoconductive imaging members with blocking layers of certain polyurethanes.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments, which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

An electrophotographic imaging member or photoconductor may be provided in a number of forms. For example, the imaging member may be a homogeneous layer of a single material such as vitreous selenium, or it may be a composite layer containing a photoconductor and another material. In addition, the imaging member may be layered. These layers can be in any order, and sometimes can be combined in a single or mixed layer. A number of photoconductors are disclosed in U.S. Pat. No. 5,489,496; U.S. Pat. No. 4,579,801; U.S. Pat. No. 4,518,669; U.S. Pat. No. 4,775,605; U.S. Pat. No. 5,656,407; U.S. Pat. No. 5,641,599; U.S. Pat. No. 5,344,734; U.S. Pat. No. 5,721,080; and U.S. Pat. No. 5,017,449, the entire disclosures of which are totally incorporated herein by reference. Also, photoreceptors are disclosed in U.S. Pat. No. 6,200,716; U.S. Pat. No. 6,180,309; and U.S. Pat. No. 6,207,334, the entire disclosures of which are totally incorporated herein by reference.

A number of undercoat or charge blocking layers are disclosed in U.S. Pat. No. 4,464,450; U.S. Pat. No. 5,449,573; U.S. Pat. No. 5,385,796; and, U.S. Pat. No. 5,928,824, the entire disclosures of which are totally incorporated herein by reference.

The appropriate suitable components and processes of the above patents may be selected for the photoconductors of the present disclosure in embodiments thereof.

The demand for improved print quality in xerographic reproduction processes is increasing, especially with the advent of color. Common print quality issues are, for example, dependent on the quality of the undercoat layer (UCL), or hole blocking layer. In certain situations, a thicker undercoat is desirable, but the thickness of the material used for the undercoat layer may be limited by the inefficient transport of the photo-injected electrons from the generator layer to the substrate. When the undercoat layer is too thin, then incomplete coverage of the substrate may result due primarily to wetting problems on localized unclean substrate surface areas. The incomplete coverage produces pin holes which can, in turn, produce print defects such as charge deficient spots (CDS) and bias charge roll (BCR) leakage breakdown. Other problems include "ghosting", which is thought to result from the accumulation of charge somewhere in the photoreceptor. Removing trapped electrons and holes residing in the imaging members is one key to preventing or minimizing ghosting. During the exposure and development stages of xerographic cycles, the trapped electrons are mainly at or near the interface between the charge generating layer (CGL) and the undercoating layer (UCL), and holes are present mainly at or near the interface between the charge generating layer and the charge transport layer (CTL). The trapped charges can migrate according to the electric field during the transfer stage where the electrons can move from the interface of CGL/UCL to CTL/CGL or the holes from CTL/CGL to CGL/UCL, and became deep traps that are no longer mobile. Consequently, when a sequential image is printed, the accumulated charge results in image density changes in the current printed image that reveals the previously printed image. Thus, there is a need to minimize or eliminate charge accumulation in photoreceptors without sacrificing the thickness of the undercoat layer, and a need for permitting the UCL to properly adhere to the other photoconductive layers, such as the photogenerating layer, for extended time periods, such as for example, about 4,000,000 simulated xerographic imaging cycles.

Thick undercoat layers are desirable for photoreceptors as such layers permit photoconductor life extension and carbon fiber resistance. Furthermore, thicker undercoat layers permit the use of economical substrates in the photoreceptors. Examples of thick undercoat layers are disclosed in U.S. application Ser. No. 10/942,277, filed Sep. 16, 2004, U.S. Publication 20060057480, entitled "Photoconductive Imaging Members", the entire disclosure of which is totally incorporated herein by reference. However, due primarily to insufficient electron conductivity in dry and cold environments, the residual potential in conditions, such as 10 percent relative humidity and 70° F., can be unacceptably high when the undercoat layer is thicker than 15 microns, and moreover, the adhesion of the UCL may be poor, disadvantages avoided or minimized with the UCL of the present disclosure.

SUMMARY

According to embodiments illustrated herein, there are provided photoconductors that enable excellent print quality, and wherein ghosting is minimized or substantially eliminated in images printed in systems with high transfer current, and where adhesion of the UCL is improved as compared to a number of UCLs with no adhesion promoter.

In particular, disclosed in an embodiment is an electrophotographic imaging member comprising a substrate, an undercoat layer contained on the substrate wherein the undercoat layer comprises a polyol resin, an aminoplast resin, and a metal oxide dispersed therein, and at least one imaging layer formed on the undercoat layer, and wherein the undercoat layer contains at least one adhesion agent, component, or promoter.

Embodiments disclosed herein also provide an electrophotographic imaging member comprising a substrate, an undercoat layer disposed or deposited on the substrate wherein the undercoat layer comprises a suitable resin or resin mixture, such as an acrylic polyol or a styrene acrylic polyol resin, a melamine resin, an adhesion component, and titanium oxide dispersed therein, and a photogenerating layer and charge transport layer formed on the undercoat layer; an electrophotographic imaging member comprising a substrate, an undercoat layer disposed on the substrate wherein the undercoat layer comprises a phenolic resin, a melamine resin, an adhesion component, and titanium oxide dispersed therein, and a photogenerating layer and charge transport layer formed on the undercoat layer; an electrophotographic imaging member comprising a substrate, an undercoat layer disposed on the substrate wherein the undercoat layer comprises a phenolic resin, an adhesion component, and titanium oxide dispersed therein, and a photogenerating layer and charge transport layer formed on the undercoat layer; an image forming apparatus for forming images on a recording medium comprising (a) an electrophotographic imaging member having a charge-retentive surface to receive an electrostatic latent image thereon wherein the electrophotographic imaging member comprises a substrate, an undercoat layer disposed on the substrate wherein the undercoat layer comprises a polyol resin, an aminoplast resin, an adhesion component, and a metal oxide dispersed therein, and at least one imaging layer, such as for example, a photogenerating layer and at least one charge transport layer formed on the undercoat layer, (b) a development component adjacent to the charge-retentive surface for applying a developer material to the charge-retentive surface to develop the electrostatic latent image to form a developed image on the charge-retentive surface, (c) a transfer component adjacent to the charge-retentive surface for transferring the developed image from the charge-retentive surface to a copy substrate, and (d) a fusing component adjacent to the copy substrate for fusing the developed image to the copy substrate.

DETAILED DESCRIPTION

Aspects of the present disclosure relate to members comprising a substrate, an undercoat layer thereover wherein the undercoat layer comprises a polyol resin, an aminoplast resin, an adhesion component, and a metal oxide dispersed therein, and at least one imaging layer formed on the undercoat layer; a photoconductor comprising a substrate, an undercoat layer thereover comprising a polyol resin, an aminoplast resin, at least one ester of a phosphoric acid adhesion component, and a metal oxide; a photoconductor comprising a substrate, an undercoat layer thereover comprising a polyol resin, an aminoplast resin, at least one polymeric phosphate ester adhesion component, and a metal oxide, a photogenerating layer and at least one, such as from 1 to about 4, charge transport layers; a photoconductor comprising a supporting substrate, a layer thereover comprising a mixture of a polyol resin, an aminoplast resin, an adhesion component, and a metal oxide, and a photogenerating layer and a charge transport layer; a photoconductor wherein the photogenerating layer is situated between the charge transport layer and the substrate, and wherein the adhesion component is selected from the group consisting of an ester of phosphoric acid, a polymeric phosphate ester, and mixtures thereof, and wherein the adhesion component is present in an amount of from about 0.01 to about 40 weight percent, or from about 0.1 to about 10 weight percent of the undercoat layer; a photoreceptor comprising an undercoat layer containing an additive that reduces, and in embodiments substantially eliminates, specific printing defects such as ghosting in the resulting printed images; an imaging member comprising a substrate, a layer thereover comprised of a polyol resin, an aminoplast resin, a polymeric phosphate ester adhesion component, and a metal oxide; and one imaging layer formed on the polyol resin containing layer; a photoconductor comprising a substrate, a layer thereover comprising a polyol resin, an aminoplast resin, at least one polymeric phosphate ester, and a metal oxide; and thereover a photogenerating layer and at least one charge transport layer; a photoconductor comprising a supporting substrate, a hole blocking layer thereover comprising a polyol resin, an aminoplast resin, a polymeric phosphate ester, and a metal oxide; and a photogenerating layer and a charge transport layer; and wherein the polymeric phosphate ester is a carboxyl phosphate ester, a hydroxyl phosphate ester, or a methacrylol functionalized phosphate; and a photoconductor comprising a hole blocking layer comprising a polyol resin, an aminoplast resin, a polymeric phosphate ester, and a metal oxide; and a photogenerating layer and a charge transport layer; and wherein said polymeric phosphate ester is a carboxyl phosphate ester, a hydroxyl phosphate ester, or a methacrylol functionalized phosphate ester.

Examples of adhesion additives, components, promoters selected in various suitable amounts, such as for example, from about 0.01 to about 40, from about 0.1 to about 20, from 1 to about 10 weight percent, or from 0.1 to about 30, include polymeric phosphate esters, such as hydroxyl, carboxyl or methacrylol functionalized polymeric phosphate esters with, for example, a weight average molecular weight ($M_w$) from about 200 to about 5,000, and a polydispersity of from about 1 to about 2; esters of phosphoric acid, such as phosphate esters of alkyl alcohol ethoxylates, alkyl phenol ethoxylates, alkyl polyethoxyethanol, alkylphenoxy polyethoxyethanol wherein alkyl is, for example, from 1 to about 30 carbon atoms, optionally mixtures thereof, and the like, reference copending application U.S. application Ser. No. 11/496,912, the disclosure of which is totally incorporated herein by reference.

In embodiments, the adhesion promoter can be incorporated in the undercoat layer by (1) directly adding it into the prepared undercoat layer dispersion comprising a metal oxide, polymeric resins and solvents; or (2) ball milling together with the metal oxide, polymeric resins, solvents to generate the undercoat layer dispersion. Examples of the adhesion promoter polymeric phosphate esters of carboxyl phosphate esters are of the formula

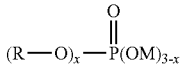

wherein R is an aliphatic group with, for example, from about 5 to about 40 carbon atoms ($C_5$-$C_{40}$) in which one or more aliphatic carbon atoms are substituted with lateral or terminal —COOR' groups, wherein R' is H, a suitable metal, ammonium, alkyl with, for example, from about 1 to about 6 carbon atoms, or aryl with, for example, from about 6 to about 24 carbon atoms, M is hydrogen, metal or ammonium and x is a number such as from 0 to about 3.

Suitable carboxyl phosphate esters generally comprise the reaction product of (a) at least one difunctional polyol, (b) phosphoric acid, and (c) at least one trifunctional carboxylic acid. Examples of suitable difunctional polyols (a) include neopentanediol, ethylene glycol, diethylene glycol, propylene glycol, dipropylene glycol, hydrogenated bisphenol A, 1,6-hexanediol, hydroxypivalylhydroxypivalate, cyclohexanedimethanol, 1,4-butanediol, 2-ethyl-1,3-hexandiol, 2,2,4-trimethyl-1,3-pentandiol, 2-ethyl-2-butyl-1,3-propanediol, 2-methyl-1,3-propanediol, and mixtures thereof. The at least one trifunctional carboxylic acid (c) may be aromatic or aliphatic in nature, with the aromatic containing components being of somewhat higher value. Examples of suitable trifunctional carboxylic acids are trimellitic acid, 1,3,5-benzenetricarboxylic acid, citric acid, and mixtures thereof. Polymerization of the reactants (a), (b), and (c) may occur at typical esterification conditions, such as for example, from about 200 to about 230° C. reaction temperature while continuously removing water as a reaction byproduct. Solvents that facilitate the removal of water from the reaction system (those that form an azeotrope), such as xylenes, may be used. The reaction mixture can also be subsequently admixed with suitable solvents.

Specific examples of carboxyl functionalized polymeric phosphate esters include LUBRIZOL™ 2063 (the free acid of complex carboxyl phosphate ester, about 58 weight percent of solids in a butyl cellosolve, such as 2-butoxyethanol), LUBRIZOL™ 2062 (the free acid complex alkyl/aryl phosphate ester supplied in the range of about 59 to about 66 weight percent solids in isobutanol) and LUBRIZOL™ 2061 (the free acid complex alkyl phosphate ester supplied in the range of about 62 to about 70 weight percent solids in butyl cellosolve), all available from Noveon, Inc., Cleveland, Ohio. Specific examples of methacrylol functionalized polymeric phosphate esters include GENORAD™ 40, available from RAHN AG, Switzerland.

Phosphate esters of alkyl alcohol ethoxylate examples, include POLYSTEP™ P-11, P-12 and P-13 (polyethylene glycol monotridecyl ether phosphate, available from STEPAN Company, Northfield, Ill.). Examples of phosphate esters of alkyl phenol ethoxylates include POLYSTEP™ P-31, P-32, P-33, P-34 and P-35 (nonylphenol ethoxylate phosphate, available from STEPAN Company, Northfield, Ill.); and examples of phosphate esters of alkyl polyethoxyethanol include STEPFAC™ 8180, 8181 and 8182 (polyethylene glycol monotridecyl ether phosphate, available from STEPAN Company, Northfield, Ill.). Examples of phosphate esters of alkylphenoxy polyethoxyethanol include STEP- FAC™ 8170, 8171, 8172, 8173, 8175 (nonylphenol ethoxylate phosphate, available from STEPAN Company, Northfield, Ill.), DEXTROL™ OC-22 and STRODEX™ MR-100, available from Dexter Chemical LLC, Bronx, N.Y.

In embodiments, the polyol resin selected for the UCL is an acrylic polyol resin, a styrene acrylic polyol resin, and/or a phenolic resin such as a styrene acrylic copolymer, a $M_w$ of about 15,000, available as JONCRYL™ 580 from John Polymer, Sturtevant, Mich. Acrylic polyol resins or acrylic examples refer, for example, to copolymers of derivatives of acrylic and methacrylic acid including acrylic and methacrylic esters and compounds containing nitrile and amide groups, and other suitable optional monomers. Styrene acrylic polyol resins or styrene acrylics are considered copolymers of styrene, derivatives of acrylic and methacrylic acid, including acrylic and methacrylic esters, and compounds containing nitrile and amide groups, and other optional monomers. The acrylic esters can, for example, be alkyl acrylates such as methyl, ethyl, propyl, butyl, pentyl, hexyl, heptyl, octyl, nonyl, decyl, dodecyl, tetradecyl, or hexadecyl acrylate; secondary and branched chain alkyl acrylates such as isopropyl, isobutyl, sec-butyl, 2-ethylhexyl, or 2-ethylbutyl acrylate; olefinic acrylates such as allyl, 2-methylallyl, furfuryl, or 2-butenyl acrylate; aminoalkyl acrylates such as 2-(dimethylamino)ethyl, 2-(diethylamino)ethyl, 2-(dibutylamino)ethyl, or 3-(diethylamino)propyl acrylate; ether acrylates such as 2-methoxyethyl, 2-ethoxyethyl, tetrahydrofurfuryl, or 2-butoxyethyl acrylate; cycloalkyl acrylates such as cyclohexyl, 4-methylcyclohexyl, or 3,3,5-trimethylcyclohexyl acrylate; halogenated alkyl acrylates such as 2-bromoethyl, 2-chloroethyl, or 2,3-dibromopropyl acrylate; glycol acrylates and diacrylates such as ethylene glycol, propylene glycol, 1,3-propanediol, 1,4-butanediol, diethylene glycol, 1,5-pentanediol, triethylene glycol, dipropylene glycol, 2,5-hexanediol, 2,2-diethyl-1,3-propanediol, 2-ethyl-1,3-hexanediol, or 1,10-decanediol acrylate and diacrylate. The methacrylic esters can be comprised of alkyl methacrylates such as methyl, ethyl, propyl, isopropyl, n-butyl, isobutyl, sec-butyl, t-butyl, n-hexyl, n-octyl, isooctyl, 2-ethylhexyl, n-decyl, or tetradecyl methacrylate; unsaturated alkyl methacrylates such as vinyl, allyl, oleyl, or 2-propynyl methacrylate; cycloalkyl methacrylates such as cyclohexyl, 1-methylcyclohexyl, 3-vinylcyclohexyl, 3,3,5-trimethylcyclohexyl, bornyl, isobornyl, or cyclopenta-2,4-dienyl methacrylate; aryl methacrylates such as phenyl, benzyl, or nonylphenyl methacrylate; hydroxyalkyl methacrylates such as 2-hydroxyethyl, 2-hydroxypropyl, 3-hydroxypropyl, or 3,4-dihydroxybutyl methacrylate; ether methacrylates such as methoxymethyl, ethoxymethyl, 2-ethoxyethoxymethyl, allyloxymethyl, benzyloxymethyl, cyclohexyloxymethyl, 1-ethoxyethyl, 2-ethoxyethyl, 2-butoxyethyl, 1-methyl-(2-vinyloxy)ethyl, methoxymethoxyethyl, methoxyethoxyethyl, vinyloxyethoxyethyl, 1-butoxypropyl, 1-ethoxybutyl, tetrahydrofurfuryl, or furfuryl methacrylate; oxiranyl methacrylates such as glycidyl, 2,3-epoxybutyl, 3,4-epoxybutyl, 2,3-epoxycyclohexyl, or 10,11-epoxyundecyl methacrylate; aminoalkyl methacrylates such as 2-dimethylaminoethyl, 2-diethylaminoethyl, 2-t-octylaminoethyl, N,N-dibutylaminoethyl, 3-diethylaminopropyl, 7-amino-3,4-dimethyloctyl, N-methylformamidoethyl, or 2-ureidoethyl methacrylate; glycol dimethacrylates such as methylene, ethylene glycol, 1,2-propanediol, 1,3-butanediol, 1,4-butanediol, 2,5-dimethyl-1,6-hexanediol, 1,10-decanediol, diethylene glycol, or triethylene glycol dimethacrylate; trimethacrylates such as trimethylolpropane trimethacrylate; carbonyl-containing methacrylates such as carboxymethyl, 2-carboxyethyl, acetonyl, oxazolidinylethyl, N-(2-methacryloyloxyethyl)-2-pyrrolidinone, N-methacryloyl-2-pyrrolidinone, N-(metharyloyloxy)formamide, N-methacryloylmorpholine, or tris(2-methacryloxyethyl)amine methacrylate; other nitrogen-containing methacrylates such as 2-methacryloyloxyethylmethyl cyanamide, methacryloyloxyethyltrimethyl ammonium chloride, N-(methacryloyloxy-ethyl) diisobutylketimine, cyanomethyl, 2-cyanoethyl methacrylate; halogenated alkyl methacrylates such as chloromethyl, 1,3-dichloro-2-propyl, 4-bromophenyl, 2-bromoethyl, 2,3-dibromopropyl, 2-iodoethyl methacrylate; sulfur-containing methacrylates such as methylthiol, butylthiol, ethylsulfonylethyl, ethylsulfinylethyl, thiocyanatomethyl, 4-thiocyanatobutyl, methylsulfinylmethyl, 2-dodecylthioethyl methacrylate, or bis(methacryloyloxyethyl) sulfide; phosphorous-boron-silicon-containing methacrylates such as 2-(ethylenephosphito)propyl, dimethylphosphinomethyl, dimethylphosphonoethyl, diethylphosphatoethyl, 2-(dimethylphosphato)propyl, 2-(dibutylphosphono)ethyl methacrylate, diethyl methacryloylphosphonate, dipropyl methacryloyl phosphate, diethyl methacryloyl phosphite, 2-methacryloyloxyethyl diethyl phosphite, 2,3-butylene methacryloyloxy-ethyl borate, or methyldiethoxy methacryloyloxyethoxysilane. The methacrylic amides and nitriles can be selected, for example, from N-methylmethacrylamide, N-isopropylmethacrylamide, N-phenylmethacrylamide, N-(2-hydoxyethyl)methacrylamide, 1-methacryloylamido-2-methyl-2-propanol, 4-methacryloylamido-4-methyl-2-pentanol, N-(methoxymethyl) methacrylamide, N-(dimethylaminoethyl)methacrylamide, N-(3-dimethylaminopropyl) methacrylamide, N-acetylmethacrylamide, N-methacryloylmaleamic acid, methacryloylamidoacetonitrile, N-(2-cyanoethyl) methacrylamide, 1-methacryloylurea, N-phenyl-N-phenylethylmethacrylamide, N-(3-dibutylaminopropyl) methacrylamide, N,N-diethylmethacrylamide, N-(2-cyanoethyl)-N-methylmethacrylamide, N,N-bis(2-diethylaminoethyl)methacrylamide, N-methyl-N-phenylmethacrylamide, N,N'-methylenebismethacrylamide, N,N'-ethylenebismethacrylamide, or N-(diethylphosphono) methacrylamide. Examples of optional monomers are, for example, acrolein, acrylic anhydride, acrylonitrile, acryloyl chloride, methacrolein, methacrylonitrile, methacrylic anhydride, methacrylic acetic anhydride, methacryloyl chloride, methacryloyl bromide, itaconic acid, butadiene, vinyl chloride, vinylidene chloride, vinyl acetate, and mixtures thereof.

Examples of acrylics include, but are not limited to, PARALOID™ AT-410 (73 percent in methyl amyl ketone, $T_g$=30° C., OH equivalent weight=880, acid number=25, $M_w$=9,000), AT-400 (75 percent in methyl amyl ketone, $T_g$=15° C., OH equivalent weight=650, acid number=25, $M_w$=15,000), AT-746 (50 percent in xylene, $T_g$=83° C., OH equivalent weight=1,700, acid number=15, $M_w$=45,000), and AT-63 (75 percent in methyl amyl ketone, $T_g$=25° C., OH equivalent weight=1,300, acid number=30), all available from Rohm and Haas, Philadelphia, Pa. Examples of styrene acrylics include, but are not limited to, JONCRYL™ 500 (80 percent in methyl amyl ketone, $T_g$=−5° C., OH equivalent weight=400), 550 (62.5 percent in PM-acetate/toluene=65/35, OH equivalent weight=600), 551 (60 percent in xylene, OH equivalent weight=600), 580 ($T_g$=50° C., OH equivalent weight=350, acid number=10, $M_w$=15,000), 942 (73.5 percent in n-butyl acetate, OH equivalent weight=400), and 945 (78 percent in n-butyl acetate, OH equivalent weight=310), all available from Johnson Polymer, Sturtevant, Wis.

The phenolic resins selected are, for example, comprised of condensation products of an aldehyde with a phenol source in the presence of an acidic or basic catalyst. The phenol source may be, for example, phenol, alkyl-substituted phenols such as cresols and xylenols, halogen-substituted phenols such as chlorophenol, polyhydric phenols such as resorcinol or pyrocatechol, polycyclic phenols such as naphthol and bisphenol A, aryl-substituted phenols, cyclo-alkyl-substituted phenols, aryloxy-substituted phenols, and combinations thereof. The phenol source may be phenol, 2,6-xylenol, o-cresol, p-cresol, 3,5-xylenol, 3,4-xylenol, 2,3,4-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, p-phenoxy phenol, multiple ring phenols, such as bisphenol A, and mixtures thereof. The aldehyde may be, for example, formaldehyde, paraformaldehyde, acetaldehyde, butyraldehyde, paraldehyde, glyoxal, furfuraldehyde, propinonaldehyde, benzaldehyde, and mixtures thereof.

Also, phenolic resins that may be selected are, for example, dicyclopentadiene type phenolic resins, phenol novolak resins, cresol novolak resins, phenol aralkyl resins, and combinations thereof; formaldehyde polymers with phenol, p-tert-butylphenol, and cresol, such as VARCUM™ 29159 and 29101 (OxyChem Company) and DURITE™ 97 (Borden Chemical), formaldehyde polymers with ammonia, cresol, and phenol, such as VARCUM™ 29112 (OxyChem Company), formaldehyde polymers with 4,4'-(1-methylethylidene)bisphenol such as VARCUM™ 29108 and 29116 (OxyChem Company), or formaldehyde polymers with cresol and phenol such as VARCUM™ 29457 (OxyChem Company), DURITE™ SD-423A, SD-422A (Borden Chemical), or formaldehyde polymers with phenol and p-tert-butylphenol such as DURITE™ ESD 556C (Border Chemical). The phenolic resins can be used as purchased, or they can be modified to enhance certain properties thereof. For example, the phenolic resins can be modified with suitable plasticizers, including, but not limited to, polyvinyl butyral, polyvinyl formal, alkyds, epoxy resins, phenoxy resins (bisphenol A, epichlorohydrin polymer) polyamides, oils, and the like.

In embodiments, aminoplast resin refers, for example, to a type of amino resin generated from a nitrogen-containing substance and formaldehyde wherein the nitrogen-containing substance includes melamine, urea, benzoguanamine, and/or glycoluril. Melamine resins include amino resins generated from melamine and formaldehyde. Melamine resins are known under various trademarks, including but not limited to CYMEL™, BEETLE™, DYNOMIN™, BECKAMINE™, UFR™, BAKELITE™, ISOMIN™, MELAICAR™, MELBRITE™, MELMEX™, MELOPAS™, RESART™, and ULTRAPAS™. Urea resins can be considered as being prepared from urea and formaldehyde. Urea resins include, but are not limited to, CYMEL™, BEETLE™, UFRM, DYNOMIN™, BECKAMINE™, and AMIREME™; benzoguanamine resins include amino resins generated from benzoguanamine and formaldehyde, including, but not limited to, CYMEL™, BEETLE™, and UFORMITE™. Glycoluril resins can be considered amino resins generated from glycoluril and formaldehyde including, but not limited to, CYMEL™, and POWDERLINK™. The aminoplast resins can be highly alkylated or partially alkylated.

Melamine resin examples include those of the following formula/structure

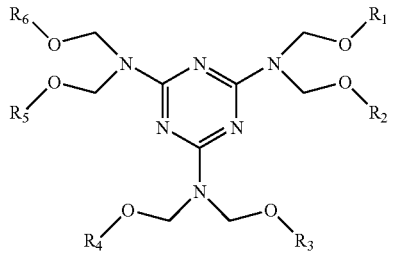

wherein $R_1$, $R_2$, $R_3$, $R_4$, $R_5$ and $R_6$ each independently represents a hydrogen atom or a suitable substituent like a suitable hydrocarbon such as an alkyl chain with, for example, from 1 to about 8 carbon atoms, or from 1 to about 4 carbon atoms. In embodiments, the melamine resin is water-soluble, dispersible or nondispersible. Melamine resin examples include highly alkylated/alkoxylated, partially alkylated/alkoxylated, or mixed alkylated/alkoxylated, and more specifically, the melamine resin can be methylated, n-butylated or isobutylated. Examples of the melamine resin include highly methylated melamine resins such as CYMEL™ 350, 9370; methylated high imino melamine resins (partially methylolated and highly alkylated) such as CYMEL™ 323, 327; partially methylated melamine resins (highly methylolated and partially methylated) such as CYMEL™ M 373, 370; high solids mixed ether melamine resins such as CYMEL™ 1130, 324; n-butylated melamine resins such as CYMEL™ 1151, 615; and n-butylated high imino melamine resins such as CYMEL™ 1158; iso-butylated melamine resins such as CYMEL™ 255-10, and a methylated melamine resin, about 78 to about 82 weight percent in isobutanol with a viscosity at 23° C. of about 2,500 to about 7,500, and available as CYMEL™ 323. CYMEL™ melamine resins are commercially available from CYTEC Corporation.

A number of specific examples of the melamine resin are methylated formaldehyde-melamine resin, methoxymethylated melamine resin, ethoxymethylated melamine resin, propoxymethylated melamine resin, butoxymethylated melamine resin, hexamethylol melamine resin, alkoxyalkylated melamine resins such as methoxymethylated melamine resin, ethoxymethylated melamine resin, propoxymethylated melamine resin, butoxymethylated melamine resin, and mixtures thereof.

Examples of a urea resin selected is, for example, of the formula

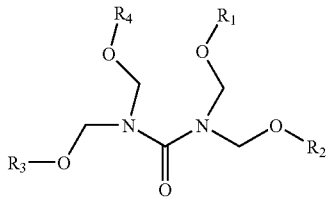

wherein $R_1$, $R_2$, $R_3$, and $R_4$ each independently represents a hydrogen atom and/or a suitable substituent like an alkyl chain with, for example, 1 to about 8 carbon atoms, or 1 to about 4 carbon atoms. In embodiments, the urea resin is water soluble, dispersible or nondispersible. In various embodiments, the urea resin can be highly alkylated/alkoxylated, partially alkylated/alkoxylated, or mixed alkylated/alkoxylated, and more specifically, the urea resin can be methylated, n-butylated or isobutylated. Examples of the urea resin include methylated urea resins such as CYMEL™ U-65, and U-382; n-butylated urea resins such as CYMEL™ U-1054, and UB-30-B; and iso-butylated urea resins such as CYMEL™ U-662, and UI-19-I. CYMEL™ urea resins are commercially available from CYTEC Corporation.

Benzoguanamine resins selected can be represented by the following formula/structure

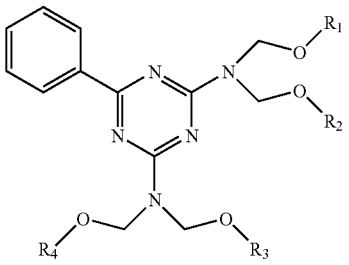

wherein $R_1$, $R_2$, $R_3$, and $R_4$ each independently represents a hydrogen atom and/or a suitable hydrocarbon like alkyl with, for example, 1 to about 8 carbon atoms, or with 1 to about 4 carbon atoms.

A number of examples of the benzoguanamine resins are water soluble, dispersible or nondispersible. Thus, the benzoguanamine resin can be highly alkylated/alkoxylated, partially alkylated/alkoxylated, or mixed alkylated/alkoxylated, and more specifically, the benzoguanamine resin can be methylated, n-butylated or isobutylated. Examples of the benzoguanamine resin include CYMEL™ 659, 5010, and 5011. CYMEL™ benzoguanamine resins are commercially available from CYTEC Corporation.

In embodiments, the glycoluril resin selected is of the formula

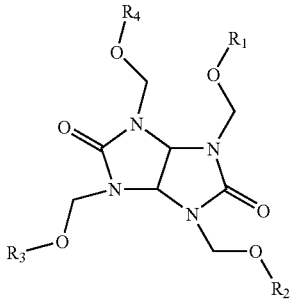

wherein $R_1$, $R_2$, $R_3$, and $R_4$ each independently represents a hydrogen atom and/or a suitable hydrocarbon like alkyl with, for example, 1 to about 8 carbon atoms, or with 1 to about 4 carbon atoms. More specifically, examples of the glycoluril resin include water soluble, dispersible or nondispersible resins. The glycoluril resin can be highly alkylated/alkoxylated, partially alkylated/alkoxylated, or mixed alkylated/alkoxylated, and more specifically, the glycoluril resin can be methylated, n-butylated or isobutylated. Specific examples of the glycoluril resin include CYMEL™ 1170, and 1171. CYMEL™ glycoluril resins are commercially available from CYTEC Corporation.

The ratio amount of the polyol resin to the aminoplast resin in the polyol/aminoplast co-resin can be, for example, about 1/99 to about 99/1, from about 20/80 to about 80/20, or from about 30/70 to about 70/30. Suitable hydrocarbon refers, for example, to alkyl, alkoxy, aryl, and the like in embodiments.

Metal oxide examples are ZnO, $SnO_2$, $TiO_2$, $Al_2O_3$, $SiO_2$, $ZrO_2$, $In_2O_3$, $MoO_3$, and complex oxides of the above-mentioned metals thereof. The metal oxide has, for example, a powder volume resistivity varying from about $10^4$ to about $10^{10}$ Ωcm at a 100 kilogram/$cm^2$ loading pressure, 50 percent humidity, and at room temperature. Also, the metal oxide like $TiO_2$ can be either surface treated or used untreated. Surface treatments include, but are not limited to, aluminum laurate, alumina, zirconia, silica, silane, methicone, dimethicone, sodium metaphosphate, and mixtures thereof.

Examples of $TiO_2$ include STR-60N™ (no surface treatment and powder volume resistivity of approximately $9\times10^5$ Ωcm) (available from Sakai Chemical Industry Co., Ltd.), FTL-100™ (no surface treatment and powder volume resistivity of approximately $3\times10^5$ Ωm) (available from Ishihara Sangyo Laisha, Ltd.), STR-60™ ($Al_2O_3$ coated and powder volume resistivity of approximately $4\times10^6$ Ωcm) (available from Sakai Chemical Industry Co., Ltd.), TTO-55N™ (no surface treatment and powder volume resistivity of approximately $5\times10^5$ Ωcm) (available from Ishihara Sangyo Laisha Ltd.), TTO-55A™ ($Al_2O_3$ coated and powder volume resistivity of approximately $4\times10^7$ Ωcm) (available from Ishihara Sangyo Laisha, Ltd.), MT-150W™ (sodium metaphosphated coated and powder volume resistivity of approximately $4\times10^4$ Ωcm) (available from Tayca), and MT-150AW™ (no surface treatment and powder volume resistivity of approximately $1\times10^5$ Ωcm) (available from Tayca). The weight ratio of the metal oxide to the co-resin can be, for example, from about 20/80 to about 80/20, or from about 40/60 to about 65/35.

The undercoat layer may optionally contain an acid catalyst primarily to permit rapid curing, examples of such catalysts being a para-toluene sulfonic acid; CYCAT™ 4040, commercially available from CYTEC Technology Corporation; an amine neutralized para-toluene sulfonic acid; NACURE™ 2107, commercially available from King Industries; an amine neutralized phenyl acid phosphate; NACURE™ 4575 commercially available from King Industries; an amine neutralized dinonylnaphthalenedisulfonic acid; NACURE™ 3525, commercially available from King Industries; a polyol/aminoplast co-resin wherein the polyol/aminoplast co-resin is cured at temperatures of from about 120° C. to about 195° C., or from about 145° C. to about 160° C. for a period of from about 10 minutes to about 60 minutes, or from about 20 minutes to about 45 minutes. In embodiments, the acid catalyst can be present in various suitable amounts, such as for example, in an amount of from about 0 percent to about 1 percent, or from about 0.1 percent to about 0.4 percent by weight of the total weight of the undercoat layer.

The undercoat layer may optionally contain a light scattering particle or particles, which have, for example, a refractive index different from the polymeric resins and with, for example, a number average particle size greater than about 0.8 μm. Examples of the light scattering particles include, but are not limited to, inorganic materials such as amorphous silica, silicone ball and minerals. Typical minerals include, for example, metal oxides, silicates, carbonates, sulfates, iodites, hydroxides, chlorides, fluorides, phosphates, chromates, clay, sulfur, and the like. In various embodiments, the light scattering particles are comprised of amorphous silica P-100, commercially available from Espirit Chemical Co. In embodiments, the light scattering particle or particles can be present in various suitable amounts, such as for example, an amount of from about 0 percent to about 10 percent, or from about 2 percent to about 5 percent by weight of the total weight of the undercoat layer.

The undercoat layer may also contain one or more conventional binders. Examples of conventional binders include, but are not limited to, polyamides, vinyl chlorides, vinyl acetates, phenols, polyurethanes, melamines, benzoguanamines, polyimides, polyethylenes, polypropylenes, polycarbonates, polystyrenes, acrylics, methacrylics, vinylidene chlorides, polyvinyl acetals, epoxys, silicones, vinyl chloride-vinyl acetate copolymers, polyvinyl alcohols, polyesters, polyvinyl butyrals, nitrocelluloses, ethyl celluloses, caseins, gelatins, polyglutamic acids, starches, starch acetates, amino starches, polyacrylic acids, polyacrylamides, zirconium chelate compounds, titanyl chelate compounds, titanyl alkoxide compounds, organic titanyl compounds, silane coupling agents, and mixtures thereof. The conventional binders can be present in an amount of, for example, from about 1 to about 60 weight percent, or from about 10 to about 30 weight percent of the undercoat layer.

Further, the undercoat layer may additionally contain various colorants, examples of which are organic pigments and organic dyes, including, but not limited to, azo pigments, quinoline pigments, perylene pigments, indigo pigments, thioindigo pigments, bisbenzimidazole pigments, phthalocyanine pigments, quinacridone pigments, quinoline pigments, lake pigments, azo lake pigments, anthraquinone pigments, oxazine pigments, dioxazine pigments, triphenylmethane pigments, azulenium dyes, squalium dyes, pyrylium dyes, triallylmethane dyes, xanthene dyes, thiazine dyes, and cyanine dyes. The colorants can be present in an amount of, for example, from about 0.1 to about 30 weight percent, or from about 1 to about 10 weight percent of the undercoat layer. The undercoat layer may include inorganic materials, such as amorphous silicon, amorphous selenium, tellurium, a selenium-tellurium alloy, cadmium sulfide, antimony sulfide, titanium oxide, tin oxide, zinc oxide, zinc sulfide, and mixtures thereof. The inorganic materials can be present in an amount of, for example, from about 1 to about 60 weight percent, or from about 10 to about 30 weight percent of the undercoat layer.

The undercoat layer may, for example, be situated between the electroconductive support/substrate and the photogenerating layer. The undercoat or hole blocking layer is primarily effective for blocking leakage of charge from the electroconductive support/substrate to the photogenerating layer and/or for improving the adhesion between the electroconductive support/substrate and the photogenerating layer. The undercoat layer may be applied or coated onto a substrate by any suitable known technique, such as spraying, dip coating, draw bar coating, gravure coating, silk screening, air knife coating, reverse roll coating, vacuum deposition, chemical treatment, and the like. Additional vacuuming, heating, drying, and the like may be used to remove any solvent remaining after the application or coating to form the undercoat layer. Thus, the undercoat layer can be coated onto the conductive support/substrate from a suitable solvent. Suitable solvents include, but are not limited to, xylene/1-butanol/MEK, N,N-dimethyl formamide, N,N-dimethyl acetamide, dimethyl sulfoxide, tetrahydrofuran, dichloromethane, xylene, toluene, methanol, ethanol, 1-butanol, isobutanol, methyl ethyl ketone, methyl isobutyl ketone, and mixtures thereof. The thickness of the undercoat layer is, for example, from about 0.1 μm to 30 μm, from about 2 μm to 20 μm, or from about 4 μm to 15 μm. Also, in embodiments, electrophotographic imaging members can include undercoat layers having a thickness of from about 0.1 μm to 30 μm, from about 2 μm to 20 μm, or from about 4 μm to 15 μm.

Moreover, the hole blocking or undercoat layer can contain a number of components in addition to the adhesion promoter component including, for example, known hole blocking components, such as amino silanes, doped metal oxides; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl) methane), M (4,4'-(1,3-phenylenediisopropylidene) bisphenol), P (4,4'-(1,4-phenylenediisopropylidene) bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like. The known hole blocking components can be present in an amount from about 1 to about 40 weight percent, or from about 10 to about 20 weight percent of the undercoat layer.

The thickness of the photoconductive substrate layer depends on many factors, including economical considerations, electrical characteristics, and the like, thus this layer may be of substantial thickness, for example over 3,000 microns, such as from about 300 to about 700 microns, or of a minimum thickness. In embodiments, the thickness of this layer is from about 75 microns to about 300 microns, or from about 100 to about 150 microns.

The substrate may be opaque or substantially transparent and may comprise any suitable material, including known materials. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, as disclosed in a copending application referenced herein, this layer may be of substantial thickness of, for example, up to many centimeters or of a minimum thickness of less than a millimeter. Similarly, a flexible belt may be of substantial thickness of, for example, about 250 micrometers, or of minimum thickness of less than about 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factor.

Illustrative examples of substrates are as illustrated herein, and more specifically, substrates selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer in embodiments is comprised of, for example, Type V hydroxygallium phthalocyanine or chlorogallium phthalocyanine, and a resin binder like poly (vinyl chloride-co-vinyl acetate)copolymer, such as VMCH™ available from Dow Chemical. Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations. The photogenerating layer binder resin is present in various suitable amounts, for example from about 1 to about 50, and more specifically, from about 1 to about 10 weight percent, and which resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may be comprised of amorphous films of selenium and alloys of selenium and arsenic, tellurium, germanium and the like, hydrogenated amorphous silicon and compounds of silicon and germanium, carbon, oxygen, nitrogen, and the like fabricated by vacuum evaporation or deposition. The photogenerating layers may also comprise inorganic pigments of crystalline selenium and its alloys; Group II to VI compounds; and organic pigments such as quinacridones; polycyclic pigments such as dibromo anthanthrone pigments, perylene and perinone diamines, polynuclear aromatic quinones, azo pigments including bis-, tris- and tetrakis-azos; hydroxygallium phthalocyanines, metal free phthalocyanines, metal phthalocyanines, hydroxy halophthalocyanines, titanyl phthalocyanines, and the like dispersed in a film forming polymeric binder and fabricated by solvent coating techniques.

Phthalocyanines have been selected as photogenerating materials in laser printers using infrared exposure systems usually desired for photoreceptors exposed to low-cost semiconductor laser diode light exposure devices. The absorption spectrum and photosensitivity of the phthalocyanines depend on the central metal atom of the compound. Many metal phthalocyanines, which can be selected for the photogenerating layer, have been reported and include oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal free phthalocyanine. The phthalocyanines exist in many crystal forms, and have a strong influence on photogeneration.

Examples of polymeric binder materials that can be selected as the matrix for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like. The coating of the photogenerating layer on the UCL in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 1 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. The hole blocking layer or UCL may be applied to the electrically conductive surface prior to the application of a photogenerating layer.

A suitable known adhesive layer can be included in the photoconductor. Typical adhesive layer materials include, for example, polyesters, polyurethanes, and the like. The adhesive layer thickness can vary, and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like. As optional adhesive layers usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure, further desirable electrical and optical properties.

A number of charge transport materials, especially known hole transport molecules, may be selected for the charge transport layer, examples of which are aryl amines of the formula/structure, and which layer is generally of a thickness of from about 5 microns to about 75 microns, and more specifically, of a thickness of from about 10 microns to about 40 microns

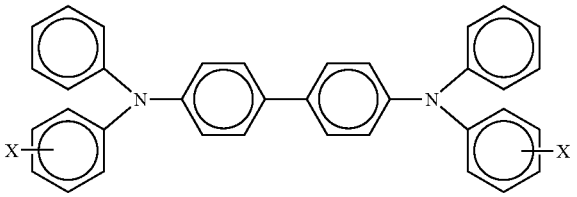

wherein X is a suitable hydrocarbon like alkyl, alkoxy, and aryl; a halogen, or mixtures thereof, and especially those substituents selected from the group consisting of Cl and $CH_3$; and molecules of the following formula

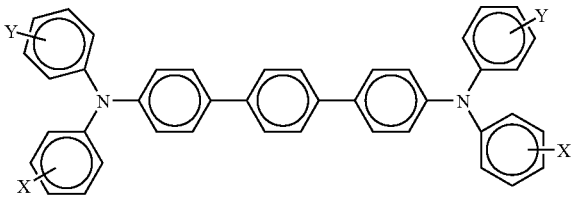

wherein X and Y are a suitable substituent like a hydrocarbon, such as independently alkyl, alkoxy, aryl, a halogen, or mixtures thereof. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layer or layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of charge transporting molecules, especially for the first and second charge transport layers, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone, and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material or a combination of a small molecule charge transport material and a polymeric charge transport material.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

A number of processes may be used to mix and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is, for example, from about 10 to about 75, from about 15 to about 50 micrometers, but thicknesses outside these ranges may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to about 200:1, and in some instances 400:1. The charge transport layer is substantially nonabsorbing to visible light or radiation in the region of intended use, but is electrically "active" in that it allows the injection of photogenerated holes from the photoconductive layer or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and can be up to about 10 micrometers. In embodiments, this thickness of each transport layer can be, for example, from about 1 micrometer to about 5 micrometers. Various suitable and conventional methods may be used to mix, and thereafter apply the overcoat layer coating mixture to the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration. Free carrier concentration in the overcoat increases the dark decay.

The following Examples are provided. All proportions are by weight unless otherwise indicated.

Illustrative photoconductors were fabricated as follows. Multilayered photoreceptors of the rigid drum design were fabricated by conventional coating technology with an aluminum drum of 34 millimeters in diameter as the substrate. All the photoreceptors contained the same photogenerating layer and charge transport layer components. The difference is that Comparative Example 1 contained an undercoat layer (UCL) comprising an acrylic polyol resin, a melamine resin, and titanium oxide; Example I contained the same layers as Comparative Example 1 except that a carboxyl phosphate ester was incorporated into the UCL; Example II contained the same layers as Comparative Example 1 except that an alkyl/aryl phosphate ester is incorporated into the UCL; Example III contained an undercoat layer (UCL) comprising a phenolic resin, titanium oxide and a carboxyl phosphate ester; Example 4 contained an undercoat layer (UCL) comprising a melamine resin, a styrene acrylic copolymer, titanium oxide and a carboxyl phosphate ester; Example V contained an undercoat layer (UCL) comprising a melamine resin, a phenolic resin, titanium oxide and a carboxyl phosphate ester.

COMPARATIVE EXAMPLE 1

The undercoat layer was prepared as follows: a titanium oxide/acrylic polyol resin/melamine resin dispersion was prepared by ball milling 15 grams of titanium dioxide (MT-150W™, Tayca Company), 5 grams of the acrylic polyol resin (PARALOID™ AT-400, Rohm and Haas), and 5 grams of the melamine resin (CYMEL™ 323, CYTEC Corporation) in 15 grams of methyl ethyl ketone with 120 grams of 1 millimeter diameter sized $ZrO_2$ beads for 1 day. The resulting titanium dioxide dispersion was filtered with a 20 micrometer pore size nylon cloth, and then the filtrate was measured with Horiba Capa 700 Particle Size Analyzer, and there was obtained a median $TiO_2$ particle size of 50 nanometers in diameter and a $TiO_2$ particle surface area of about 15 $m^2$/gram with reference to the above $TiO_2$/PARALOID™/CYMEL™ dispersion. Then an aluminum drum, cleaned with detergent and rinsed with deionized water, was coated with the above generated coating dispersion, and subsequently, dried at 145° C. for 30 minutes, which resulted in an undercoat layer deposited on the aluminum, and comprised of $TiO_2$/PARALOID™/CYMEL™ with a weight ratio of about 60/20/20 and a thickness of 5 μm.

The photogenerating layer was prepared as follows: 2.7 grams of Type B chlorogallium phthalocyanine (ClGaPc) pigment were mixed with about 2.3 grams of polymeric binder VMCH (Dow Chemical), 30 grams of xylene, and 15 grams of n-butyl acetate. The mixture was milled in an attritor mill with about 200 grams of 1 millimeter Hi-Bea borosilicate glass beads for about 3 hours. The dispersion was filtered through a 20 μm nylon cloth filter, and the solid content of the dispersion was diluted to about 5.8 weight percent with a mixture of xylene/n-butyl acetate=2/1 (weight/weight). The ClGaPc photogenerating layer dispersion was applied on top of the above undercoat layer. The thickness of the photogenerating layer was approximately 0.2 μm.

Subsequently, a 30 μm charge transport layer was coated on top of the photogenerating layer, which coating dispersion was prepared as follows: N,N'-diphenyl-N,N-bis(3-methylphenyl)-1,1'-biphenyl-4,4'-diamine (5.38 grams), a film forming polymer binder PCZ 400™ [poly(4,4'-dihydroxydiphenyl-1-1-cyclohexane, $M_w$=40,000)], available from Mitsubishi Gas Chemical Company, Ltd. (7.13 grams), and PTFE POLYFLON™ L-2 microparticle (1 gram) available from Daikin Industries were dissolved/dispersed in a solvent mixture of 20 grams of tetrahydrofuran (THF) and 6.7 grams of toluene via CAVIPRO™ 300 nanomizer (Five Star technology, Cleveland, Ohio). The charge transport layer was dried at about 120° C. for about 40 minutes.

EXAMPLE I

A photoconductor was prepared by repeating the process of Comparative Example 1 except there were added to the undercoat layer dispersion 0.25 grams of LUBRIZOL™ 2063 (the free acid of complex carboxyl phosphate ester, about 58 weight percent of solids in a butyl cellosolve, such as 2-butoxyethanol, available from Noveon, Inc., Cleveland, Ohio). The dispersion was allowed to mix for at least 4 hours before coating it on the substrate.

EXAMPLE II

A photoconductor was prepared by repeating the process of Comparative Example 1 except there were added to the undercoat layer dispersion 0.25 grams of LUBRIZOL™ 2062 (the free acid of complex alkyl/aryl phosphate ester supplied in the range of 59 to 66 weight percent solids in isobutanol, available from Noveon, Inc., Cleveland, Ohio). The dispersion was allowed to mix for at least 4 hours before coating it on the substrate.

EXAMPLE III

A photoconductor is prepared by repeating the process of Comparative Example 1 with the exception that the undercoat layer is prepared as follows: a carboxyl phosphate ester/titanium oxide/phenolic resin dispersion is prepared by ball milling 0.5 grams of LUBRIZOL™ 2063 (the free acid of complex carboxyl phosphate ester, about 58 weight percent of solids in a butyl cellosolve, such as 2-butoxyethanol, available from Noveon, Inc., Cleveland, Ohio), 15 grams of titanium dioxide (MT-150W™, Tayca Company), and 10 grams of the phenolic resin (VARCUM™ 29159, OxyChem Company, $M_w$ of about 3,600, viscosity of about 200 cps) in 7.5 grams of 1-butanol, and 7.5 grams of xylene with 120 grams of 1 millimeter diameter sized $ZrO_2$ beads for 5 days. The resulting carboxyl phosphate ester/titanium dioxide/phenolic resin dispersion is filtered with a 20 micrometer pore size nylon cloth. Then an aluminum drum, cleaned with detergent and rinsed with deionized water, is coated with the above generated coating dispersion, and subsequently, dried at 160° C. for 15 minutes, which results in an undercoat layer deposited on the aluminum, and comprised of carboxyl phosphate ester/$TiO_2$/VARCUM™ with a weight ratio of about 2/60/40 and a thickness of 10 μm.

EXAMPLE IV

A photoconductor is prepared by repeating the process of Comparative Example 1 with the exception that the undercoat layer dispersion is prepared as follows: in a 120 milliliter glass bottle, 1 gram of LUBRIZOL™ 2063 (the free acid of complex carboxyl phosphate ester, about 58 weight percent of solids in a butyl cellosolve, such as 2-butoxyethanol, available from Noveon, Inc., Cleveland, Ohio), 15 grams of $TiO_2$ MT-150W™ (available from Tayca Company), 5 grams of JONCRYL™ 580 (available from Johnson Polymers LLC), 5 grams of CYMEL™ 323 (80 weight percent in isopropanol, available from CYTEC Corporation), and 30 grams of MEK were mixed with 150 grams of 2 millimeter $ZrO_2$ beads. The ball milling is carried out for 30 hours under 200 rpm. The dispersion is filtered through a 20 μm nylon cloth filter. Then an aluminum drum, cleaned with detergent and rinsed with deionized water, is coated with the above generated coating dispersion, and subsequently, dried at 160° C. for 40 minutes, which results in an undercoat layer deposited on the aluminum and comprised of carboxyl phosphate ester/$TiO_2$/JONCRYL™/CYMEL™ with a weight ratio of about 4/60/20/20, and a thickness of 15 μm.

EXAMPLE V

A photoconductor is prepared by repeating the process of Comparative Example 1 with the exception that the undercoat layer dispersion is prepared as follows: in a 120 milliliter glass bottle, 1 gram of LUBRIZOL™ 2063 (the free acid of complex carboxyl phosphate ester, about 58 weight percent of solids in a butyl cellosolve, such as 2-butoxyethanol, available from Noveon, Inc., Cleveland, Ohio), 15 grams of $TiO_2$ MT-150W™ (available from Tayca Company), 5 grams of the phenolic resin (VARCUM™ 29159, OxyChem Company, $M_w$ of about 3,600, viscosity of about 200 cps), 5 grams of CYMEL™ 323 (80 weight percent in isopropanol, available from CYTEC Corporation, and 30 grams of MEK were mixed with 150 grams of 2 millimeter $ZrO_2$ beads. The ball milling is carried out for 5 days under 200 rpm. The dispersion is filtered through a 20 μm nylon cloth filter. Then an aluminum drum, cleaned with detergent and rinsed with deionized water, is coated with the above generated coating dispersion, and subsequently dried at 160° C. for 40 minutes, which results in an undercoat layer deposited on the aluminum, and comprised of carboxyl phosphate ester/$TiO_2$/VARCUM™/CYMEL™ with a weight ratio of about 4/60/20/20 and a thickness of 15 μm.

An empirical peel test was performed to determine the adhesion properties of the undercoat layer with other imaging layers and the substrate. This test involved scoring the drum with a razor in a crosshatch pattern with 4 to 6 millimeter spacing, affixing a 1 inch piece of scotch tape to the device, and removing it and examining the amount of delamination onto the tape. An empirical scale was developed from Grade 1 to Grade 5 with Grade 1 resulting in almost no delamination and with Grade 5 resulting in almost complete delamination. With the addition of polymeric phosphate ester into the undercoat layer (Example I), the adhesion was improved by about 1 to 2 grades, as compared to the photoconductor of Comparative Example 1.

The first two photoreceptor devices (Comparative Example 1 and Example I) were also tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of 700 volts with the exposure light intensity incrementally increased by means of regulating a series of neutral density filters; the exposure light source was a 780 nanometer light emitting diode. The aluminum drum was rotated at a speed of 55 revolutions per minute to produce a surface speed of 277 millimeters per second or a cycle time of 1.09 seconds. The xerographic simulation was completed in an environmentally controlled light tight chamber at ambient conditions (40 percent relative humidity and 22° C.). Two photoinduced discharge characteristic (PIDC) curves were generated. Incorporation of the polymeric phosphate esters into undercoat layers had little effect on PIDC.

The two devices were acclimated for 24 hours before testing at 70° F. and 10 percent humidity for ghosting. Print testing was conducted in the Xerox Corporation Copeland Work Centre Pro 3545 using K station at t=500 print counts. Run-up from t=0 to t=500 print counts for the devices was conducted in one of the CYM color stations. Ghosting levels were measured against Technology & Systems Integration delivery Unit (TSIDU) SIR scale (from Grade 1 to Grade 6). The smaller the ghosting grade (absolute value), the better the print quality. The ghosting results are summarized in Table 1 wherein, for example, incorporation of polymeric phosphate esters into the undercoat layer reduced ghosting by more than one grade.

TABLE 1

| | Ghosting | |
|---|---|---|
| | t = 0 | t = 500 Prints |
| Comparative Example 1 | −1 | −3.5 |
| Example I | 0 | −2.0 |

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An imaging member consisting essentially of a substrate, a layer thereover comprised of a polyol resin, an aminoplast resin, a polymeric phosphate ester adhesion component, and a metal oxide; and at least one imaging layer formed on the polyol resin containing layer.

2. An imaging member in accordance with claim 1 wherein the thickness of the polyol containing layer is from about 0.1 micron to about 40 microns; wherein the imaging layer is comprised of a photogenerating layer and a charge transport layer, and wherein at least one charge transport is from 1 to about 4.

3. An imaging member in accordance with claim 1 wherein the weight ratio of the polyol resin and the aminoplast resin is from about 1/99 to about 99/1, and wherein said polymeric phosphate ester is at least one of a carboxyl phosphate ester, a hydroxyl phosphate ester, and a methacrylol functionalized phosphate ester.

4. An imaging member in accordance with claim 3 wherein the weight ratio of the polyol resin, and the aminoplast resin is from about 30/70 to about 70/30.

5. An imaging member in accordance with claim 1 wherein the metal oxide is present in an amount of from about 10 percent to about 90 percent by weight of the total weight of the polyol resin containing layer.

6. An imaging member in accordance with claim 1 further including a crosslinking agent in the polyol resin containing layer, the crosslinking agent being selected from the group consisting of at least one of p-toulenesulfonic acid, naphthalenesulfonic acid, phthalic acid, maleic acid, amine salts of inorganic acids, and ammonium salts of inorganic acids wherein the imaging layer is comprised of a photogenerating layer and a charge transport layer; wherein at least one charge transport is from 1 to about 4; and wherein said polymeric phosphate ester is at least one of a carboxyl phosphate ester, a hydroxyl phosphate ester, and a methacrylol functionalized phosphate ester.

7. A photoconductor comprising a substrate, a layer thereover comprising a polyol resin, an aminoplast resin, at least one polymeric phosphate ester, and a metal oxide; and thereover a photogenerating layer and at least one charge transport layer.

8. A photoconductor in accordance with claim 7 wherein the polyol resin is selected from the group consisting of at least one of acrylic polyols, polyglycols, polyglycerols, styrene acrylic polyols, and phenolics.

9. A photoconductor in accordance with claim 7 wherein the aminoplast resin is selected from the group consisting of at least one of a melamine-formaldehyde resin, a urea-formaldehyde resin, a benzoguanamine-formaldehyde resin, and a glycoluril-formaldehyde resin.

10. A photoconductor in accordance with claim 7 wherein the metal oxide is selected from the group consisting of at least one of titanium oxide, zinc oxide, tin oxide, aluminum oxide, silicon oxide, zirconium oxide, indium oxide, and molybdenum oxide, and wherein said at least one charge transport layer is from 1 to about 4, and at least one phosphate ester is 1.

11. A photoconductor in accordance with claim 7 wherein the metal oxide has a powder volume resistivity of from about $10^4$ to about $10^{10}$ Ωcm at an about 100 kilogram/$cm^2$ loading pressure; wherein the photogenerating layer is situated between the polyol containing layer and the charge transport layer; wherein the at least one charge transport is from 1 to about 3, wherein said substrate is comprised of an insulating component or a conductive component, and wherein at least one phosphate ester is from 1 to about 4.

12. A photoconductor in accordance with claim 7 wherein the metal oxide is titanium dioxide.

13. A photoconductor comprising a substrate, a layer thereover comprising a polyol resin, an aminoplast resin, at least one polymeric phosphate ester, and a metal oxide; and thereover a photogenerating layer and at least one charge transport layer, and wherein said polymeric phosphate ester possesses a weight average molecular weight $M_w$ of from about 200 to about 5,000, and optionally a polydispersity of about 1 to 2.

14. A photoconductor in accordance with claim 7 wherein said polymeric phosphate ester is present in an amount of from 0.01 to about 40 weight percent of the total weight of the components of the polyol containing layer.

15. A photoconductor in accordance with claim 7 wherein said polymeric phosphate ester is present in an amount of from 0.1 to about 20 weight percent of the total weight of the components of the polyol containing layer.

16. A photoconductor in accordance with claim 7 wherein said polymeric phosphate ester is present in an amount of from 1 to about 10 weight percent of the total weight of the polyol containing layer.

17. A photoconductor in accordance with claim 13 wherein said polymeric phosphate ester possesses a weight average molecular weight of from about 500 to about 1,500 and a polydispersity of about 1.1 to about 1.5, and said at least one ester is 1.

18. A photoconductor in accordance with claim 7 wherein said polymeric phosphate ester is a carboxyl phosphate ester, a hydroxyl phosphate ester, a methacrylol functionalized phosphate ester, or mixtures thereof.

19. A photoconductor in accordance with claim 7 wherein said polymeric phosphate ester is a carboxyl phosphate ester of the formula/structure $$(R—O)_x—\overset{\overset{\displaystyle O}{\|}}{P}(OM)_{3-x}$$

wherein R is an aliphatic group in which one or more aliphatic carbon atoms are substituted with lateral or terminal —COOR' groups, wherein R' is H, a suitable metal, ammonium, alkyl, or aryl, M is hydrogen, a suitable metal or ammonium, and x is a number of from 0 to 3.

20. A photoconductor in accordance with claim 19 wherein each of said metal oxide, said polyol, and said aminoplast are present in an amount of from about 20 percent to about 80 percent by weight of the total weight of the polyol containing layer components, and wherein the total thereof of said components is about 100 percent by weight inclusive of said ester, and wherein said aliphatic group contains from about 5 carbon atoms to about 40 carbon atoms, alkyl contains from 1 to about 6 carbon atoms, and aryl contains from 6 to about 42 carbon atoms.

21. A photoconductor in accordance with claim 7 wherein said charge transport layer is comprised of aryl amines represented by the formula/structure

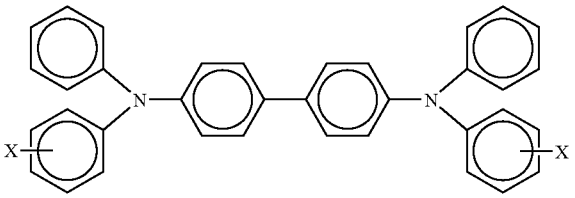

wherein X is selected from the group consisting of at least one of alkyl, alkoxy, aryl, and halogen.

22. A photoconductor in accordance with claim 21 wherein said alkyl and said alkoxy each contains from 1 to about 12 carbon atoms, and said aryl contains from 6 to about 36 carbon atoms, and wherein each at least one is from 1 to 3.

23. A photoconductor in accordance with claim 21 wherein said aryl amine is N,N'-diphenyl-N,N-bis(3-methylphenyl)-1,1'-biphenyl-4,4'-diamine.

24. A photoconductor in accordance with claim 7 wherein said charge transport layer is comprised of aryl amine molecules of the formula/structure

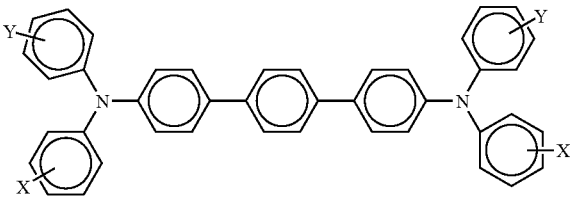

wherein X and Y are independently selected from the group consisting of at least one alkyl, alkoxy, aryl, and halogen.

25. A photoconductor in accordance with claim 24 wherein alkyl and alkoxy each contains from 1 to about 12 carbon atoms, and aryl contains from about 6 to about 36 carbon atoms.

26. A photoconductor in accordance with claim 24 wherein said aryl amine is selected from the group consisting of at least one of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine.

27. A photoconductor in accordance with claim 7 wherein said photogenerating layer is comprised of a photogenerating pigment or photogenerating pigments.

28. A photoconductor in accordance with claim 27 wherein said photogenerating pigment is comprised of at least one of a metal phthalocyanine, a metal free phthalocyanine, a titanyl phthalocyanine, a halogallium phthalocyanine, and a perylene; and wherein said at least one charge transport layer is from 1 to about 3.

29. A photoconductor in accordance with claim 27 wherein said photogenerating pigment is comprised of chlorogallium phthalocyanine wherein said photogenerating pigment is comprised of hydroxygallium phthalocyanine or wherein said photogenerating pigment is comprised of titanyl phthalocyanine, and wherein said at least one charge transport layer is from 1 to about 3.

30. A photoconductor in accordance with claim 7 wherein said photoconductor is flexible or rigid, each of said at least one is from 1 to 2, and said phosphate ester is carboxyl phosphate ester, or a hydroxyl phosphate ester.

31. A photoconductor in accordance with claim 7 wherein said at least one charge transport layer is from 1 to about 7 layers, and said phosphate ester is a carboxyl phosphate ester.

32. A photoconductor in accordance with claim 7 wherein said at least one charge transport layer is from 1 to about 3 layers.

33. A photoconductor in accordance with claim 7 wherein said at least one charge transport layer is 1.

34. A photoconductor in accordance with claim 7 wherein said at least one charge transport layer is comprised of a charge transport component and a resin binder, and said photogenerating layer is comprised of at least one photogenerating pigment and a resin binder, and said phosphate ester is a carboxyl phosphate ester, a hydroxyl phosphate ester, a methacrylol phosphate ester, or a hydroxyl carboxy functional polymeric phosphate ester.

35. A photoconductor comprising in sequence a hole blocking layer consisting essentially of a polyol resin, an aminoplast resin, a polymeric phosphate ester, and a metal oxide; a photogenerating layer and a charge transport layer; and wherein said polymeric phosphate ester is a carboxyl phosphate ester, a hydroxyl phosphate ester, or a methacrylol functionalized phosphate ester, which polymeric phosphate ester is present in an amount of from about 1 to about 10 weight percent, and wherein said charge transport layer contains N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine.

36. A photoconductor in accordance with claim 35 wherein said photogenerating layer is situated between said charge transport layer and said substrate, and which transport layer contains a resin binder; and wherein said polymeric phosphate ester is a carboxyl phosphate ester of the formula/structure

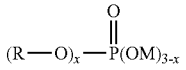

wherein R is an aliphatic group in which one or more aliphatic carbon atoms are substituted with lateral or terminal —COOR' groups, wherein R' is H, a metal, ammonium, alkyl, or awl; M is hydrogen, a metal or ammonium, and x is a suitable number; and wherein said photoconductor contains a supporting substrate in contact with said hole blocking layer.

37. A photoconductor in accordance with claim 35 wherein said charge transport is comprised of hole transport molecules and a resin binder, and said photogenerating layer is comprised of at least one photogenerating pigment and a resin binder, and wherein said polymeric phosphate ester is a carboxyl phosphate ester of the formula/structure

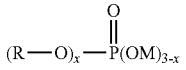

wherein R is an aliphatic group in which one or more aliphatic carbon atoms are substituted with lateral or terminal —COOR' groups, wherein R' is H, a metal, ammonium, alkyl, or awl; M is hydrogen, a metal or ammonium, and x is a number of from 0 to 3; and wherein said photoconductor contains a supporting substrate in contact with said hole blocking layer.

38. A photoconductor in accordance with claim 1 wherein imaging layer includes a photogenerating layer and a hole transport layer, and wherein said charge transport is comprised of hole transport molecules and a resin binder, and said photogenerating layer is comprised of at least one photogenerating pigment and a resin binder, and wherein said hole transport molecules are comprised of at least one of

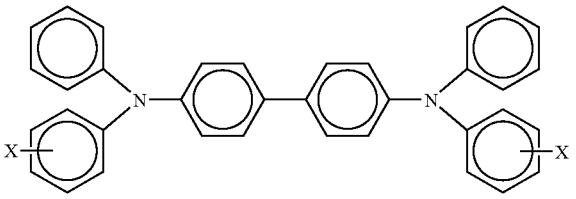

wherein X is at least one of alkyl or halogen; and

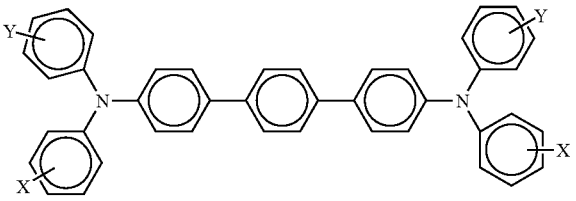

wherein X and Y are at least one of a suitable hydrocarbon and halogen, and wherein said polymeric phosphate ester is at least one of a carboxyl phosphate ester, a hydroxyl phosphate ester, and a methacrylol functionalized phosphate ester.

39. A photoconductor in accordance with claim 35 wherein said ester is a carboxyl phosphate ester, and said hole blocking layer is in contact with a supporting substrate.

40. A photoconductor consisting essentially of a substrate, a hole blocking layer thereover of a polyol resin, an aminoplast resin, a polymeric phosphate ester adhesion component, and a metal oxide; and thereover a photogenerating layer and a charge transport layer, and wherein said polymeric phosphate ester is a carboxy phosphate ester as represented by the formula/structure $$(R-O)_x-\overset{\overset{\displaystyle O}{\|}}{P}(OM)_{3-x}$$

wherein R is an aliphatic group in which one or more aliphatic carbon atoms are substituted with lateral or terminal —COOR' groups, wherein R' is H, a metal, ammonium, alkyl, or aryl; M is hydrogen, a metal or ammonium, and x is a suitable number; and wherein the charge transport layer comprises at least one of

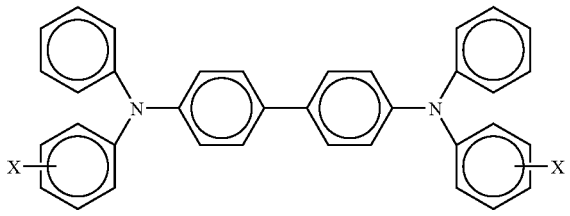

wherein X is selected from the group consisting of at least one of alkyl, alkoxy, aryl, and halogen; and

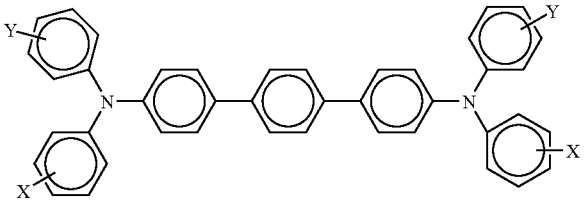

wherein X and Y are independently selected from the group consisting of at least one alkyl, alkoxy, aryl, and halogen.

* * * * *